US006408751B1

(12) United States Patent
Walczak

(10) Patent No.: US 6,408,751 B1
(45) Date of Patent: Jun. 25, 2002

(54) MULTI-COLOR, MULTI-PROCESS AUTOMATIC INK LEVELER

(75) Inventor: Peter Walczak, Lee, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/559,220

(22) Filed: Apr. 26, 2000

(51) Int. Cl.[7] ..... B41F 31/02
(52) U.S. Cl. ..... 101/365; 101/330
(58) Field of Search ..... 101/204, 207, 101/208, 210, 315, 321, 326, 330, 331, 340, 341, 344, 345, 347, 350.1, 355–357, 360, 361, 367; 118/693, 694, 710, 216, 220, 221, 225, 230, 255

(56) References Cited

U.S. PATENT DOCUMENTS

| | | | | | |
|---|---|---|---|---|---|
| 1,890,922 | A | * | 12/1932 | Waller | |
| 2,442,700 | A | * | 6/1948 | Luehrs | 101/364 |
| 2,469,796 | A | | 5/1949 | Stobb et al. | |
| 3,065,693 | A | | 11/1962 | Neal et al. | |
| 3,073,240 | A | * | 1/1963 | Tyma, Jr. et al. | 101/210 |
| 3,099,211 | A | * | 7/1963 | Hilgoe et al. | 101/207 |
| 3,585,932 | A | * | 6/1971 | Granger | 101/350 |
| 3,848,529 | A | * | 11/1974 | Gegenheimer et al. | 101/350 |
| 4,165,688 | A | * | 8/1979 | Leanna et al. | 101/207 |
| 4,585,148 | A | * | 4/1986 | Ito | 222/77 |
| 4,796,782 | A | * | 1/1989 | Wales | 222/57 |
| 4,798,228 | A | | 1/1989 | Gollinger et al. | |
| 5,085,144 | A | | 2/1992 | Lindstrom et al. | |
| 5,103,728 | A | | 4/1992 | Barney | |
| 5,694,850 | A | | 12/1997 | Pickard | |

* cited by examiner

*Primary Examiner*—Eugene Eickholt
(74) *Attorney, Agent, or Firm*—Laurence A. Greenberg; Werner H. Stemer; Ralph E. Locher

(57) ABSTRACT

An automatic multi-process ink leveler for open-fountain printing presses includes a duct with four chambers extending over the width of the ink fountain. In the case of a split ink fountain, which is typically used in newsprint presses wherein the ink tray is split into four sections each for one page of the paper web, the automatic leveler is provided with a remote-controlled valve for each chamber associated with each of the segments. Accordingly, there are provided 4×4 valves for four colors at the bottom surface of the ink leveler. By opening the remote controlled valves for a desired color (i.e., black, cyan, magenta, yellow) in the segment, a quick color change in a split ink fountain can be obtained without cleaning the entire ink leveler. In addition, different types of ink (different tack, viscosity) can be used with the same result.

9 Claims, 2 Drawing Sheets

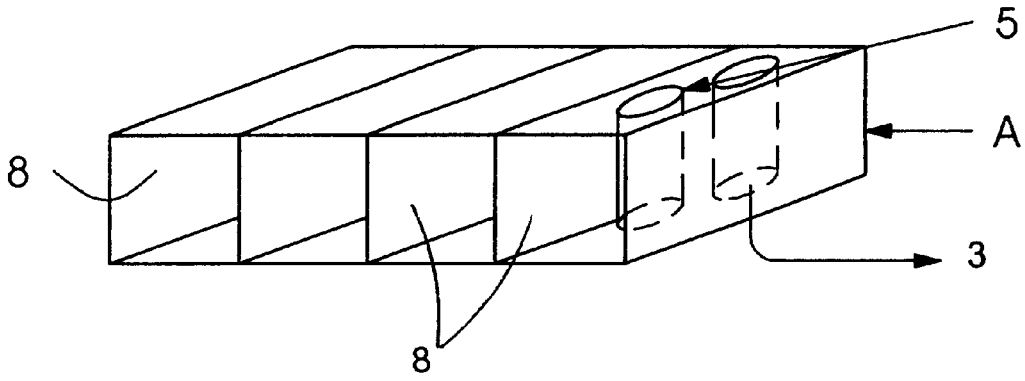
Horizontal version
Fig. 3 - Bar - Extrusion
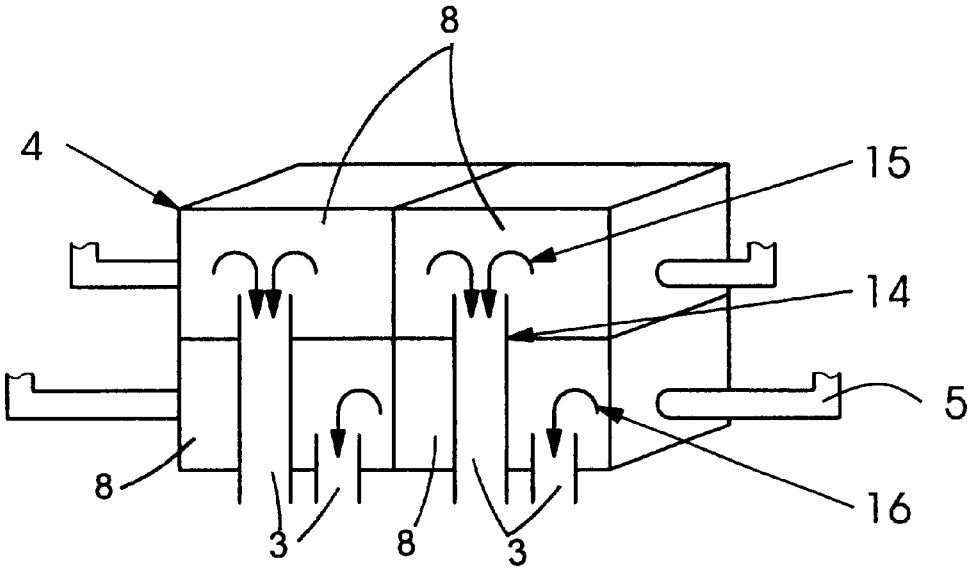
Square version
Fig. 4

MULTI-COLOR, MULTI-PROCESS AUTOMATIC INK LEVELER

BACKGROUND OF THE INVENTION

Field of the Invention

The invention lies in the field of printing technology. More specifically, the invention pertains to lithographic printing presses and, in particular, to ink levelers for open fountain printing presses.

In offset printing, ink is supplied via an ink train from an ink fountain to a plate cylinder and then to a blanket cylinder, at which the ink is transferred to the print substrate (e.g. paper). The ink train includes an ink fountain roller, also referred to as an ink pickup roller, which picks up the ink at the ink fountain and transfers it to an ink ductor roller. The ductor roller oscillates between the ink fountain roller and an ink vibrator roller and thereby transfers the ink from the ink fountain roller to the vibrator roller. From there, the ink is transferred via distributor rollers to other vibrator rollers, which distribute the ink onto several ink form rollers. The ink form rollers ink the printing plate on the plate cylinder by depositing the ink onto the oleophilic surfaces on the plate. From there, the ink is transferred onto the rubber blanket in accordance with the image to be printed.

The amount of ink that is transferred is most important for the print quality. Too much ink in the ink train leads to smearing and blurring of the printed image. Too little ink leads to faint print and uneven distribution of ink color.

The ink fountain is an ink reservoir from which the ink is transferred to the ink fountain roller. The ink fountain may be formed as an open well, as described, for example, in U.S. Pat. No. 5,085,144 to Lindstrom et al. There, the ink fountain roller dips into an open well underneath the roller and picks up the ink for transfer into the ink train. The amount of ink that is picked up by the roller is adjusted by the ink fountain blade, which essentially scrapes off any excess ink as the peripheral surface of the roller leaves the ink well. Any excess ink is drained into a drain chamber.

In a conventional prior art embodiment, the ink fountain is located laterally above the ink fountain roller, as described, for example, in U.S. Pat. No. 5,694,850 to Pickard. There, the ink well drains onto the ink fountain roller. The amount of ink that is transferred to the roller is adjusted by an ink fountain blade, which is set to open a defined gap between its blade tip and the ink fountain roller.

During the transfer of ink to the fountain roller it must always be assured that a sufficient supply of ink is present in the ink well. For that purpose, the prior art knows ink level control systems in which the ink level in the ink fountain is continually monitored. These devices are commonly referred to as ink levelers. One such ink leveler is disclosed in U.S. Pat. No. 5,103,728 to Barney. There, an ultrasonic transducer is employed to measure the ink level in the ink fountain.

All of the prior art systems have in common that only one type of color or process ink (heatset ink, coldset ink; hightack ink, low-tack ink) can be pumped into and out of a single leveler at a time. Also, before the color in a leveler can be changed, it must be thoroughly cleaned or else there must be ready for use one leveler for each of the colors to be printed in the printing unit. This leads to high demands in terms of manpower and to long delays in the make-ready between print jobs or print batches. Furthermore, a considerable amount of ink may be lost during the changeover to a new color ink or a new process ink.

SUMMARY OF THE INVENTION

It is accordingly an object of the invention to provide a multi-color, multi-process automatic ink leveler for open fountain printing presses, which overcomes the abovementioned disadvantages of the heretofore-known devices and methods of this general type and which allows fast, automatic changeover between processes and colors in a printing process.

With the foregoing and other objects in view there is provided, in accordance with the invention, an ink leveler for an open fountain printing press, comprising:

an ink leveler bar formed with a plurality of chambers;

a plurality of ink supply lines each issuing into a respective one of the ink chambers via a respective inflow valve for supplying mutually different inks to the ink chambers;

a plurality of remote-controlled outflow valves communicating with the ink chambers for outputting therefrom ink to an ink fountain of a printing press.

In accordance with an added feature of the invention, the ink leveler bar is divided into a plurality of segments dividing the ink chambers into a corresponding number of segment chambers for supplying ink to a split ink fountain. Such split ink fountains are generally used in newspaper production, where four pages or more or from a single to multiple pages across the web width are printed in parallel on the paper web.

In accordance with an additional feature of the invention, the ink leveler bar is an extruded aluminum bar.

In accordance with another feature of the invention, a remote control system is connected to and controls the outflow valves. The remote control system comprises a processor, a sensor for measuring an ink level connected to the processor and supplying a sensor signal to the processor, an actuator for driving the outflow valves connected to the processor, and a device connected to the processor for setting a desired ink level.

In accordance with a further feature of the invention, the leveler bar is a flat leveler bar having all of the chambers formed on one level. In an alternative embodiment, the leveler bar has a substantially square cross section and the chambers are disposed in pairs one above another.

In accordance with again an added feature of the invention, the plurality of chambers are four chambers each for receiving a respective color ink. Typically, the different colors are black, magenta, cyan, and yellow.

In accordance with a concomitant feature of the invention, each of the chambers receives a respective color ink and the segments are four segments, defining sixteen sub-chambers each communicating with a respective one of the outflow valves.

Commonly on multi-color, coldset and heatset offset press systems, color ink piping is provided to each ink fountain. In other words, each of the colors black, cyan, magenta, and yellow (typical) have line drops at each ink fountain, but only a single leveler to deliver the ink to the fountain. The novel system according to the invention now allows semi-automatic or automatic color changes to the ink leveler. In the prior art, the leveler had to be removed and cleaned before a new process and/or color ink could be pumped through.

When the printing press is used for both heatset and coldset applications—as with color changes—the different process inks can be changed without cleaning the leveler in the same manner as in a color ink change.

In the newspaper production context, the invention allows multi-color processing in the same ink fountain (split ink fountain is commonly used in newspaper production). Further, it is possible to have different colors of ink leveled independently of each other in the same fountain.

In summary, the automatic multi-process ink leveler according to the preferred mode is essentially a duct with four chambers extending over the width of the ink tray. In the case of a split ink fountain, which is typically used in newspaper presses wherein the ink tray is split into four different sections, the automatic leveler is provided with a remote-controlled valve for each chamber associated with each of the segments. Accordingly, there are provided 4×4 valves for four colors at the bottom surface of the ink leveler. By opening the remote controlled valves for a desired color (i.e., black, cyan, magenta, yellow) in the segment, a quick color change in a split ink fountain can be obtained without cleaning the entire ink leveler. In addition, different types of ink (different tack, viscosity) can be used with the same result.

The implementation of the system with ultrasonic sensors for sensing the ink level in each of the segments of the split ink fountain allows very accurate and real-time regulation of the supply valves and improves the accuracy of the system in general.

The invention provides for generally shorter make-ready and changeover periods. It is also applicable, however, for onthe-fly color changes or process changes.

Other features which are considered as characteristic for the invention are set forth in the appended claims.

Although the invention is illustrated and described herein as embodied in a multi-color, multi-process automatic ink leveler for open fountain printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3 is a diagrammatic perspective view of a horizontal embodiment of the invention; and FIG. 4 is a diagrammatic perspective view of a substantially square embodiment of the invention.

DESCRIPTION OF THE PREFERRED EMBODIMENTS

Figure 1:
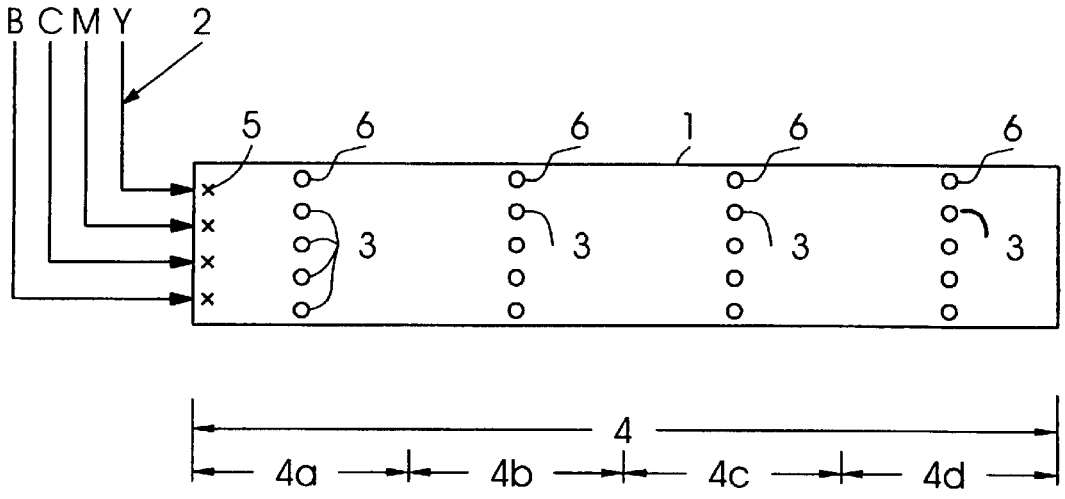
FIG. 1 is a diagrammatic bottom plan view of an ink leveler according to the invention for an open fountain printing press.

Referring now to the figures of the drawing in detail and first, particularly, to FIG. 1 thereof, there is seen an ink leveler bar 1 for multi-color, multi-process ink supply in an ink fountain of an open fountain printing press. The ink is fed into the leveler bar 1 at an ink feed 2, which connects to four basic ink supplies for black, cyan, magenta, and yellow, respectively.

The ink is output at outflow valves 3 from the leveler bar to the ink fountain or into the ink tray(s). A width 4 represents the width of the ink fountain and the sub-widths 4*a,* 4*b,* 4*c,* and 4*d* relate to the page width of each of the four pages that make up the web width being processed in the printing press (add sub-widths 4*e,* 4*f* for six wide production). Each of the supply lines of the ink feed 2 issues into the leveler bar at a respective valve 5. A multiplicity of level sensors 6 are provided for monitoring the ink level in each of the segments of the leveler bar 1.

Figure 1A:
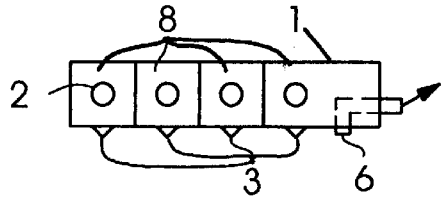
FIG. 1A is a slightly enlarged side view of the ink leveler of FIG. 1 in a mirror-symmetric embodiment.

As illustrated in the side view of FIG. 1A, the leveler bar 1 is divided into four chambers 8 that extend across the entire width of the ink fountain. In the case in which the leveler bar is formed from aluminum, the chambers 8 may be formed in an extrusion process or any other process. Other materials may be possible as well.

The multi-process ink leveler of FIG. 1 is a split ink fountain which is suitable for newspaper presses with parallel processing of four to six pages across. The ink tray is split into four corresponding segments. Each of the segments has one remote-controlled valve 3 for each of the chambers 8. Accordingly, there are provided 16 valves 3.

Figure 2:
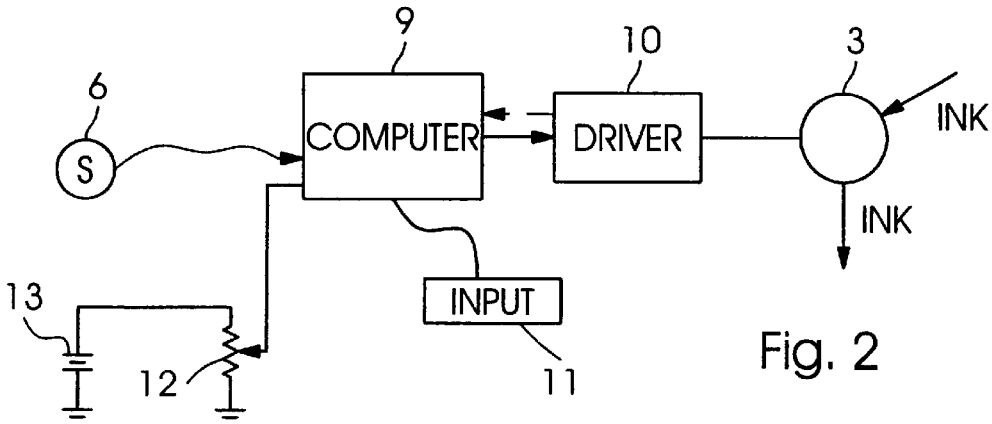
FIG. 2 is a circuit schematic of the system control according to the invention.

Referring now to FIG. 2, the control system for maintaining the proper ink level includes a computer 9 which receives measurement signals from the sensors 6. One sensor 6 is illustrated in FIG. 2. The computer 9 feeds a drive signal to a driver actuator 10, which actuates the outflow valve 3 in accordance with the drive signal. The drive signal may be derived via keyboard 11 input-(digital input through appropriate program) or via an analog input as illustrated. The desired level can be adjusted at a potentiometer 12 which is connected between a source of emf 13 and ground.

The implementation of the ultrasonic measurement system is well within the skill of the artisan. Reference is had, for example, to U.S. Pat. No. 5,103,728 to Barney and similar disclosures.

Referring now to FIG. 3, there is shown a single-level, horizontal leveler bar 1. The bar is formed from extruded aluminum or other method or material in which four chambers 8 are disposed all at the same level. The inflow valves 5 are shown at the top and the outflow valves 3 are disposed at the bottom of the bar 1. The measurement sensors 6 are not illustrated in FIG. 3 for reasons of clarity in the drawing. It is understood, however, that the sensor must be adjusted so as to point into the ink tray below the leveler, so that the pertinent ink level in the ink fountain tray can be properly measured.

Referring now to FIG. 4, there is shown a multi-level leveler bar 1. Two pairs of chambers 8 are formed one on top of the other, with a divider seal 14 in between. The outflow from the upper level chambers 8 is effected via a pipe 15, which issues into an outflow valve 3. The outflow from the lower level chambers 8 is effected via a pipe 16 which issues into a respective outflow valve 3 as well. The "square" embodiment of FIG. 4 is preferably also formed from an extruded aluminum bar.

I claim:

1. An ink leveler for an open fountain printing press, comprising:

an ink leveler bar formed with a plurality of chambers;

a plurality of ink supply lines each issuing into a respective one of said ink chambers via a respective inflow valve for supplying mutually different inks to said ink chambers;

a plurality of remote-controlled outflow valves communicating with said ink chambers for outputting therefrom ink to an ink fountain of a printing press.

2. The ink leveler according to claim 1, wherein said ink leveler bar is divided into a plurality of segments dividing said ink chambers into a corresponding number of segment chambers for supplying ink to a split ink fountain.

3. The ink leveler according to claim 1, wherein said ink leveler bar is an extruded aluminum bar.

4. The ink leveler according to claim 1, which further comprises a remote control system connected to and controlling said outflow valves, said remote control system comprising a processor, a sensor for measuring an ink level connected to said processor and supplying a sensor signal to said processor, an actuator for driving said outflow valves connected to said processor, and a device connected to said processor for setting a desired ink level.

5. The ink leveler according to claim 1, wherein said leveler bar is a flat leveler bar having all of said chambers formed on one level.

6. The ink leveler according to claim 1, wherein said leveler bar has a substantially square cross section with said chambers in pairs disposed one above another.

7. The ink leveler according to claim 1, wherein said plurality of chambers are four chambers, each for receiving a respective color ink.

8. The ink leveler according to claim 7, wherein said chambers receive black, magenta, cyan, and yellow ink, respectively.

9. The ink leveler according to claim 2, wherein said plurality of chambers are four chambers, each for receiving a respective color ink, said segments are four segments, defining sixteen sub-chambers each communicating with a respective one of said outflow valves.

* * * * *